US005564687A

United States Patent [19]

Heiler et al.

[11] Patent Number: 5,564,687

[45] Date of Patent: Oct. 15, 1996

[54] DEVICE FOR EXTEMPORANEOUSLY RAISING A TRANSPORT ROLLER IN A FEEDER OF A SHEET PROCESSING MACHINE

[75] Inventors: Peter Heiler, Forst; Joachim Hüber, Hockenhelm, both of Germany

[73] Assignee: Heidelberger Druckmaschinen AG, Heidelberg, Germany

[21] Appl. No.: 486,352

[22] Filed: Jun. 7, 1995

[30] Foreign Application Priority Data

Jun. 9, 1994 [DE] Germany ..... 44 20 186.9

[51] Int. Cl.[6] ..... B65H 29/22

[52] U.S. Cl. ..... 271/81; 271/273; 271/274

[58] Field of Search ..... 271/273, 274, 271/314, 81; 226/176, 180, 186, 187

[56] References Cited

U.S. PATENT DOCUMENTS

| | | | |
|---|---|---|---|
| 3,627,125 | 12/1991 | Sugino et al. | 226/187 |
| 4,630,815 | 12/1986 | Petersen et al. | 271/273 |
| 4,875,670 | 10/1989 | Petersen et al. | 271/81 |
| 5,011,129 | 4/1991 | Holbrook | 271/274 |
| 5,044,624 | 9/1991 | Haus et al. | 271/274 |
| 5,490,666 | 2/1996 | Albert | 271/274 |

FOREIGN PATENT DOCUMENTS

| | | | |
|---|---|---|---|
| 406001492 | 1/1994 | Japan | 271/273 |

*Primary Examiner*—H. Grant Skaggs
*Attorney, Agent, or Firm*—Herbert L. Lerner; Laurence A. Greenberg

[57] ABSTRACT

Device for extemporaneously raising a transport roller in a feeder of a sheet processing machine, wherein the transport roller is swivelably arranged on a shaft supported crosswise in a frame of the machine above a feed table, so as to execute stroking movements in synchronism with the machine and be liftable from the feed table extemporaneously by a swiveling motion of the shaft, includes an entrainer disposed on the shaft, and an adjusting member formed with a coulisse, the entrainer engaging in the coulisse with a rotary angle clearance at least equivalent to the stroking movements in synchronism with the machine, the adjusting member being swivelable, out of a stop position and counter to a spring bias, about the shaft axis and through a rotary angle greater than the rotary angle clearance.

8 Claims, 3 Drawing Sheets

DEVICE FOR EXTEMPORANEOUSLY RAISING A TRANSPORT ROLLER IN A FEEDER OF A SHEET PROCESSING MACHINE

BACKGROUND OF THE INVENTION

Field of the Invention

The invention relates to a device for extemporaneously or improvisationally raising a transport roller in a feeder of a sheet processing machine and, more particularly, such a transport roller which is swivelably arranged on a shaft supported crosswise, i.e., transversely, in a frame of the machine above a feed table, so as to execute stroking or reciprocating movements in synchronism with the machine and be liftable from the feed table extemporaneously by a swiveling motion of the shaft. The term "transport roller" encompasses those rollers which are operative for sheet transport in the feeder, especially the synchronizing rollers in the feeder of sheet-fed printing presses.

A device having these generic features has become known heretofore from published Japanese Patent Document JP-Sho 63-52841 describing a synchronizing roller in a feeder of a sheet-fed printing press. The synchronizing roller is disposed at the end of a lever which is firmly seated on a shaft which swings or oscillates over a rotary angle range, by means of a cam drive, in synchronism with the printing press, so that the synchronizing roller, or a plurality of synchronizing rollers disposed side by side periodically lift up so as to insert the respective next sheet in succession by the leading edge thereof between transport means, such as conveyor belts or tapes, for example, of the feed table and the synchronizing rollers. Thereafter, the synchronizing rollers descend again and press the sheet against the aforementioned transport means. Side-by-side synchronizing rollers are all disposed on the same shaft. For the purpose of facilitating the removal of a sheet from a feeder, for example in a press arrangement for a printing job or if there is a problem during operation, the synchronizing rollers in this conventional arrangement can be raised from the sheet on the feed table, in a condition wherein the printing press is at rest, by swiveling a hand lever. To that end, the hand lever is secured to an eccentric cam, which is rotatably supported in the frame of the printing press and is operative when pivoted counter to a lever arm secured to the shaft of the synchronizing rollers.

SUMMARY OF THE INVENTION

It is accordingly an object of the invention to provide a device for extemporaneously raising a transport roller in a feeder of a sheet processing machine of the foregoing general type which is economically constructed in such a way that it is actuatable or operatable by hand or selectively by motor while the machine is running.

With the foregoing and other objects in view, there is provided, in accordance with the invention, a device for extemporaneously raising a transport roller in a feeder of a sheet processing machine, wherein the transport roller is swivelably arranged on a shaft supported crosswise in a frame of the machine above a feed table, so as to execute stroking movements in synchronism with the machine and be liftable from the feed table extemporaneously by a swiveling motion of the shaft, comprising an entrainer disposed on the shaft, and an adjusting member formed with a coulisse, the entrainer engaging in the coulisse with a rotary angle clearance at least equivalent to the stroking movements in synchronism with the machine, the adjusting member being swivelable, out of a stop position and counter to a spring bias, about the shaft axis and through a rotary angle greater than the rotary angle clearance.

In accordance with another feature of the invention, the adjusting member is shell-shaped and surrounds the shaft of the transport roller, and a tension spring is included which is connected at respective mutually spaced locations thereof to a fixed location on the machine frame, and to means for attaching the tension spring to the adjusting member, the attaching means being disposed eccentrically to the axis of the shaft.

In accordance with a further feature of the invention, the adjusting member is formed as a cup-shaped bearing shell for one end of the shaft of the transport roller, and a coaxial and rotatable bearing support of the bearing shell in the machine frame.

In accordance with an added feature of the invention, the entrainer is formed as a radially extending pin on the shaft of the transport roller.

In accordance with an additional feature of the invention, the coulisse is formed diametrically opposite another coulisse in the bearing shell, and the entrainer is formed as a pin radially penetrating the shaft of the transport roller, respective ends of the pin engaging in each coulisse.

In accordance with yet another feature of the invention, the device includes a hand lever disposed on the adjusting member.

In accordance with a concomitant feature of the invention, the device includes a motorized drive for the adjusting member.

The device according to the invention is of relatively simple and sturdy construction, and is actuatable during operation of the sheet-processing machine, even in high-speed machines.

To that end, the adjusting member surrounds the shaft of the transport roller in the manner of a shell, and a tension spring is provided which is connected between a fixed location on the machine frame and means for attaching the tension spring to the shell-shaped adjusting member, the attaching means being disposed eccentrically to the axis of the shaft, the adjusting member being held by the tension spring against a stop which fixes or defines a rest position of the device. When the device is actuated, the adjusting member is pulled so as to overcome the force of the tension spring and until it meets a further stop, which defines or fixes the other end position of the adjusting member wherein the transport roller is in a raised condition.

In a preferred embodiment, the adjusting member is embodied as a cup-shaped bearing shell for one of the ends of the shaft on which the transport roller is secured with a lever arm, the bearing shell being disposed rotatably in the machine frame, in a coaxial relationship with the shaft, and receiving therein the bearing end of the shaft.

Other features which are considered as characteristic for the invention are set forth in the appended claims.

Although the invention is illustrated and described herein as embodied in a device for extemporaneously raising a transport roller in a feeder of a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
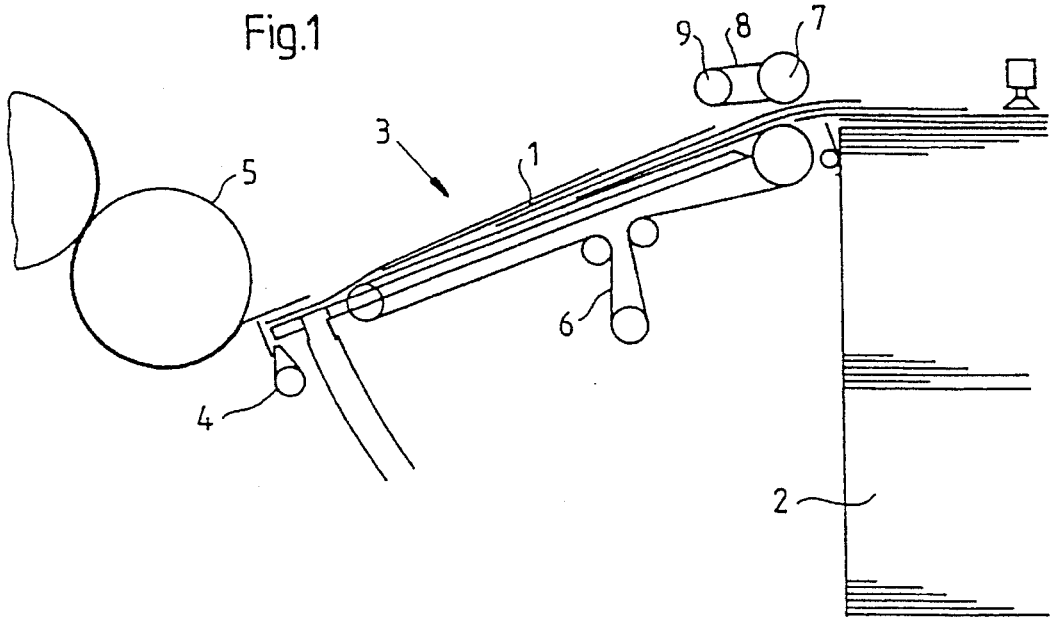
FIG. 1 is a diagrammatic side elevational view of a shingle or stream-type sheet feeder of a sheet-fed printing press.

Referring now to the drawing and, first, particularly to FIG. 1 thereof, there is shown a shingle or stream-type sheet feeder, wherein sheets 1 are singly separated and are transported from a sheet pile 2 over a feed table 3 and aligned against front lays 4 before being transferred by a further transport device, in this case a cylinder 5, to a first printing unit of an otherwise non-illustrated printing press. The transport of the sheets 1, lying on one another in an overlapping or shingled position, across the feed table 3 is effected by endlessly revolving conveyor belts 6, which are disposed beneath the sheets 1 side by side in the feed table 3, and by a synchronizing roller 7 acting on the sheets from above, the synchronizing rollers 7 being mounted on a lever arm 8 and being swivelable about a synchronizing roller shaft 9, so that it is raised from the sheets 1 in synchronism with the printing press so as to permit a sequential insertion of a respective sheet between the synchronizing roller 7 and the conveyor belts 6. Thereafter, the synchronizing roller 7 presses against the top of the sheet 1 and thus enables sheet transport across the feed table 3.

Figure 2:
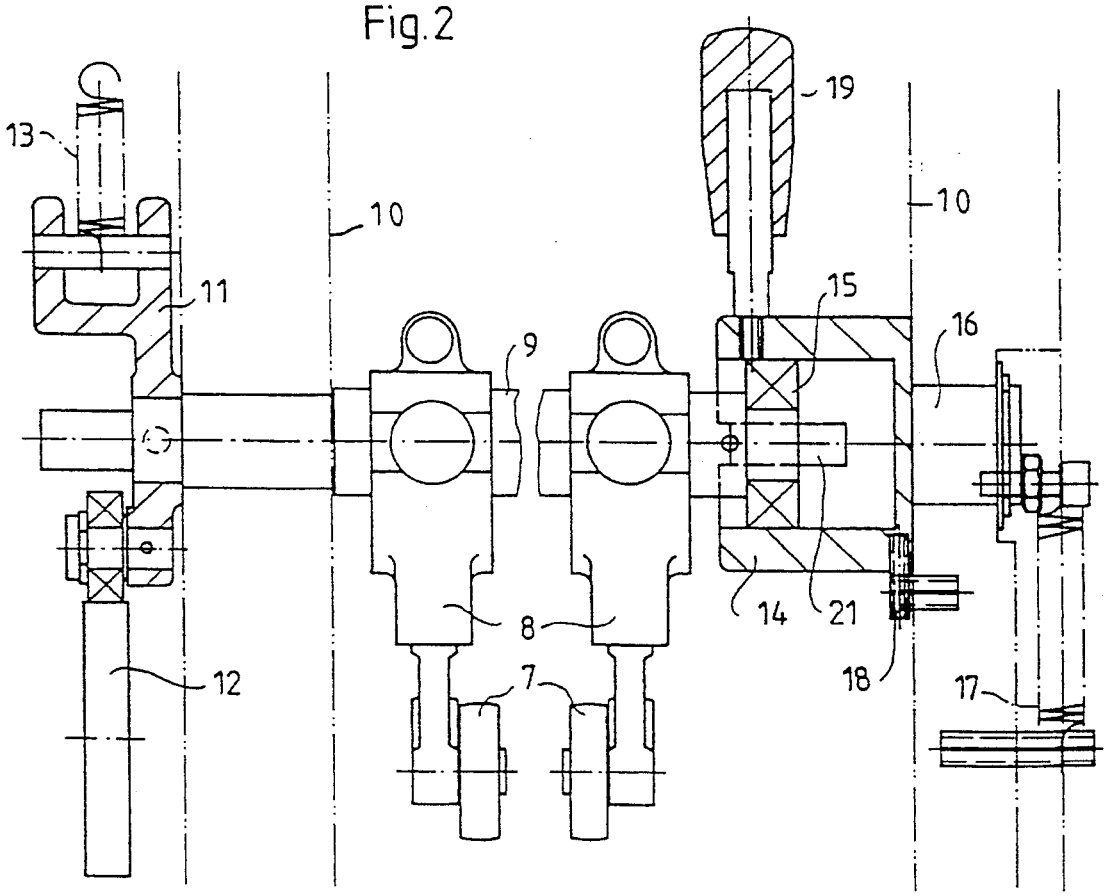
FIG. 2 is a fragmentary much-enlarged top plan view, partly in section, of FIG. 1, rotated 45° clockwise and showing synchronizing rollers of the device according to the invention disposed on a common synchronizing roller shaft.

As shown in FIG. 2, a plurality of synchronizing rollers 7 are secured by their lever arms 8 to the synchronizing roller shaft 9, the ends of which are rotatably supported or journalled in a frame 10 of the printing press. The swinging or oscillating motion of the synchronizing roller shaft 9 is effected from a zero position in a conventional manner, by means of drive members 11 and 12 connected to one of the ends of the synchronizing roller shaft 9, counter to a tensional force of a spring 13. The other end of the synchronizing roller shaft 9 is supported with a roller bearing 15 in a cup-shaped bearing shell 14 which functions as an adjusting member. Coaxially with the synchronizing roller shaft 9, the bearing shell 14 is rotatably supported or journalled in the press frame 10 by a bearing pin or trunnion 16 and is urged by a spring 17 against a stop 18, which defines or fixes the rest position of the device. The spring 17 is fixed by one end thereof to the press frame 10, and with the other end thereof engages with the pin or trunnion 16 eccentrically to the bearing axis, so that the bearing shell 14 is swivelable by a hand lever 9 about the axis of the synchronizing roller shaft 9, counter to the action of the spring 17. With a driver or entrainer 20, the synchronizing roller shaft 9 engages in a slot or coulisse 21 formed in the bearing shell 14, more specifically with a rotary-angle clearance or play which is equivalent to the maximum swiveling movements of the synchronizing roller shaft 9 in synchronism with the printing press as it is running. With the press running, the driver or entrainer 20 swings inside the slot 21 without touching the walls of the slot 21 and hence without touching the bearing shell 14. Thus, the synchronizing roller 7 can swing or oscillate between the contact pressure position thereof shown in FIG. 3 and a periodically raised position. In the case of this illustrated embodiment of the device according to the invention, the driver or entrainer 20 is formed as a pin passing through the synchronizing roller shaft 9 and having both ends of which engaging in a respective slot or coulisse 21 formed in the bearing shell 14, as shown in Figs. 3 and 4 of the drawings.

For intentionally intervening to discontinue the operation or actuation of the synchronizing rollers 7, the bearing shell 14 is swivelable by the hand lever 19 about the axis of the synchronizing roller shaft 7 counter to the action of the spring 17, overcoming the rotary angle clearance or play of the driver 20 in the slot 21, preferably until the bearing shell 14 engages a stop which defines or determines the other end position of the swiveling of the bearing shell 14. In this regard, the driver or entrainer 20 comes to rest against the wall of the slot or coulisse 21, so that the synchronizing roller shaft 9 is also entrained thereby, and the synchronizing rollers 7 are raised from the sheets on the feed table 3. This position, which is shown in FIG. 4, permits a shifting of the sheets on the feed table and the removal of single sheets. The operating position of the synchronizing rollers 7 is attained by a swiveling motion of the bearing shell 14 in the opposite direction, the spring 17 causing the return of the bearing shell 14 to the starting position.

Figure 3:
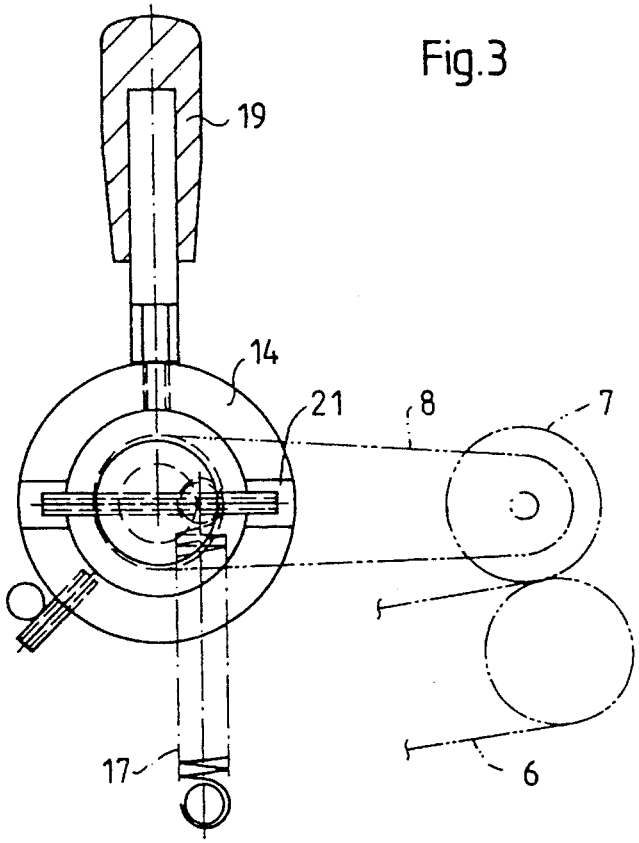
FIG. 3 is a side elevational view of FIG. 2, as seen from the right-hand side of the latter figure, and showing the device according to the invention in operating position.
Figure 4:
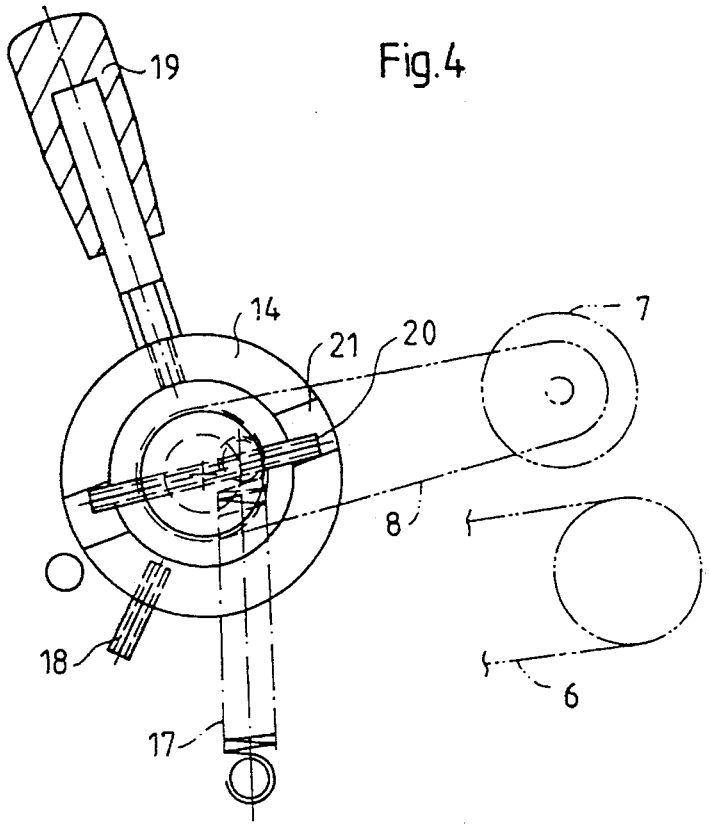
FIG. 4 is another view of FIG. 3, showing the device according to the invention in another operating phase thereof wherein the roller or rollers thereof are in a raised position.
Figure 5:
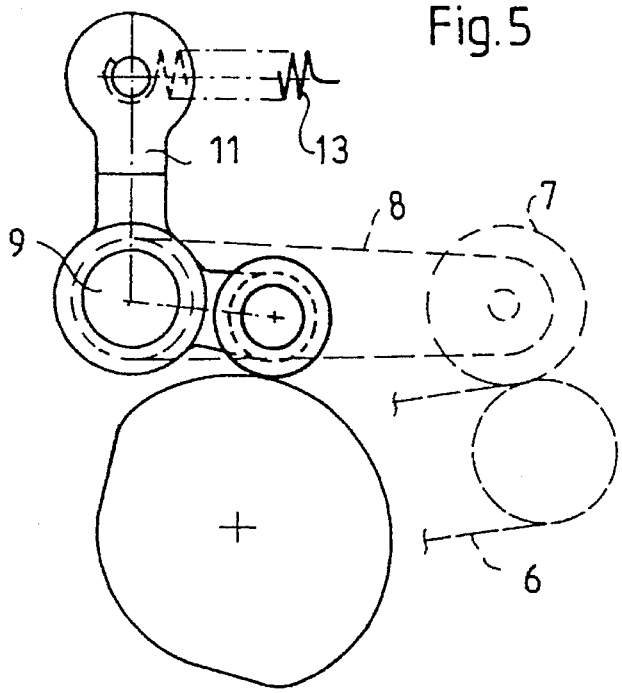
FIG. 5 is a side elevational view of FIG. 2, as seen from the left-hand side of the latter figure.
Figure 6:
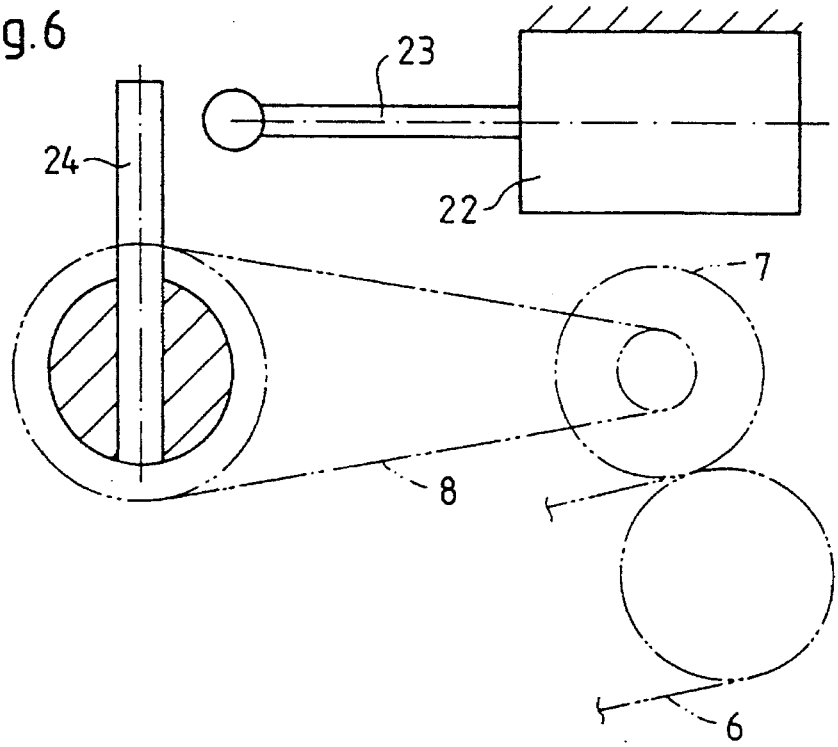
FIG. 6 is a schematic and diagrammatic side elevational view of another embodiment of the device according to the invention which is actuated or operated by a motorized drive.

Instead of the swiveling motion of the bearing shell 14 by a hand lever 19, as shown in FIGS. 2 to 4, a motor drive may also be provided, as schematically and diagrammatically shown in FIG. 6. In this embodiment of the device according to the invention, a pneumatic cylinder 22 serves as the motorized drive member; its piston rod 23 is operative counter to a lever 24 connected to the bearing shell 14, in order to produce the swiveling motion of the bearing shell 14 within the angular range shown in FIGS. 3 and 4. In an arrangement with a kinematic reversal of the function of the elements of the device described in conjunction with FIGS. 2 to 5, the lever 24 shown in FIG. 6 could also be joined directly to the synchronizing roller shaft 9 to achieve the effect sought after.

We claim:

1. Device for extemporaneously raising a transport roller in a feeder of a sheet processing machine, wherein the transport roller is swivelably arranged on a shaft supported crosswise in a frame of the machine above a feed table, so as to execute stroking movements in synchronism with the machine and be liftable from the feed table extemporaneously by a swiveling motion of the shaft, comprising an entrainer disposed on the shaft, and an adjusting member formed with a coulisse, said entrainer engaging in said coulisse with a rotary angle clearance at least equivalent to the stroking movements in synchronism with the machine, said adjusting member being swivelable, out of a stop position and counter to a spring bias, about the shaft axis and through a rotary angle greater than said rotary angle clearance.

2. Device according to claim 1, wherein said adjusting member is shell-shaped and surrounds the shaft of the transport roller, and including a tension spring connected at respective mutually spaced locations thereof to a fixed location on the machine frame, and to means for attaching said tension spring to said adjusting member, said attaching means being disposed eccentrically to the axis of the shaft.

3. Device according to claim 1, wherein said adjusting member is formed as a cup-shaped bearing shell for one end of the shaft of the transport roller, and a coaxial and rotatable bearing support of said bearing shell in the machine frame.

4. Device according to claim 3, wherein said coulisse is formed diametrically opposite another coulisse in said bearing shell, and said entrainer is formed as a pin radially penetrating the shaft of the transport roller, respective ends of said pin engaging in each of said coulisses.

5. Device according to claim 1, wherein said entrainer is formed as a radially extending pin on the shaft of the transport roller.

6. Device according to claim 1, including a hand lever disposed on said adjusting member.

7. Device according to claim 1, including a motorized drive for the adjusting member.

8. Device according to claim 7, wherein said motorized drive comprises a pneumatic cylinder.

* * * * *